US009752824B2

(12) United States Patent
Dong et al.

(10) Patent No.: US 9,752,824 B2
(45) Date of Patent: Sep. 5, 2017

(54) LOW-TEMPERATURE DEVICE FOR SEPARATING AND PURIFYING GAS BASED ON SMALL-SIZED LOW-TEMPERATURE REFRIGERATING MACHINE

(75) Inventors: Wenqing Dong, Nanjing (CN); Wei Chao, Nanjing (CN); Jie Chen, Nanjing (CN); Ao Li, Nanjing (CN); Jinlin Gao, Nanjing (CN)

(73) Assignee: CSIC PRIDE (NANJING) CRYOGENIC TECHNOLOGY CO., LTD., Nanjing (CN)

( * ) Notice: Subject to any disclaimer, the term of this patent is extended or adjusted under 35 U.S.C. 154(b) by 406 days.

(21) Appl. No.: 14/378,019

(22) PCT Filed: Mar. 23, 2012

(86) PCT No.: PCT/CN2012/072943

§ 371 (c)(1),
(2), (4) Date: Aug. 11, 2014

(87) PCT Pub. No.: WO2013/117033

PCT Pub. Date: Aug. 15, 2013

(65) Prior Publication Data

US 2015/0013349 A1 Jan. 15, 2015

(30) Foreign Application Priority Data

Feb. 10, 2012 (CN) ..... 2012 1 0029168

(51) Int. Cl.
*F25J 1/00* (2006.01)
*F25J 3/08* (2006.01)
(Continued)

(52) U.S. Cl.
CPC *F25J 1/00* (2013.01); *F25B 9/02* (2013.01); *F25B 9/14* (2013.01); *F25B 9/145* (2013.01);
(Continued)

(58) Field of Classification Search
CPC F25J 1/0005; F25J 1/0007; F25J 3/069; F25J 3/0685; F25B 9/10; F25B 9/14
See application file for complete search history.

(56) References Cited

U.S. PATENT DOCUMENTS 4,055,961 A * 11/1977 Admiraal ..... F25J 1/0005 62/48.2
4,267,701 A * 5/1981 Toscano ..... F25J 1/0007 62/402
(Continued)

FOREIGN PATENT DOCUMENTS

CN 1090921 A 8/1994
CN 101655428 A 2/2010
(Continued)

OTHER PUBLICATIONS

International Search Report issued in PCT/CN2012/072943 mailed on Nov. 22, 2012.
(Continued)

*Primary Examiner* — Frantz Jules
*Assistant Examiner* — Brian King
(74) *Attorney, Agent, or Firm* — Oliff PLC

(57) ABSTRACT

A low-temperature device for separating and purifying gas based on a small-sized low-temperature refrigerating machine includes a primary, secondary and quaternary heat exchanger, at least one small-sized low-temperature refrigerating machine, and at least one liquid collecting tank. The small-sized low-temperature refrigerating machine includes a first cold head and a second cold head, the secondary heat exchanger is provided on the first cold head to form a primary cold head heat exchanger, the quaternary heat exchanger is provided on the second cold head to form a secondary cold head heat exchanger, a mixed gas outlet is connected to an inlet of the primary cold head heat exchanger. By using primary and secondary cold heads of the small-sized low-temperature refrigerating machine as cold sources, gases having different condensing temperature are liquefied and solidified separately, and two or more gases can be separated and purified at a lower cost.

9 Claims, 1 Drawing Sheet

(51) Int. Cl.

| | |
|---|---|
| ***F25J 3/06*** | (2006.01) |
| ***F25B 9/02*** | (2006.01) |
| ***F25B 9/14*** | (2006.01) |

(52) U.S. Cl.

CPC ..... *F25J 3/069* (2013.01); *F25J 3/0685* (2013.01); *F25J 3/08* (2013.01); *F25J 2215/30* (2013.01); *F25J 2215/32* (2013.01); *F25J 2270/908* (2013.01)

(56) References Cited

U.S. PATENT DOCUMENTS

| | | | | |
|---|---|---|---|---|
| 6,062,042 | A | 5/2000 | McNeil et al. | |
| 2006/0130519 | A1* | 6/2006 | Little | F17C 7/02 62/612 |
| 2009/0211297 | A1* | 8/2009 | Schmidt | F25J 1/0022 62/620 |
| 2010/0313598 | A1 | 12/2010 | Daly et al. | |

FOREIGN PATENT DOCUMENTS

| | | | |
|---|---|---|---|
| CN | 102155610 | A | 8/2011 |
| CN | 202470623 | U | 10/2012 |

OTHER PUBLICATIONS

Written Opinion of the International Searching Authority issued in International Patent Application No. PCT/CN2012/072943 mailed on Nov. 22, 2012.

International Preliminary Report on Patentability issued in International Patent Application No. PCT/CN2012/072943 dated Aug. 12, 2014.

* cited by examiner

LOW-TEMPERATURE DEVICE FOR SEPARATING AND PURIFYING GAS BASED ON SMALL-SIZED LOW-TEMPERATURE REFRIGERATING MACHINE

BACKGROUND

Technical Field

The present invention relates to a low-temperature device for separating and purifying gas, and particularly to a low-temperature device for separating and purifying gas based on a small-sized low-temperature refrigerating machine.

Related Art

Separation and purification of component gases in an impurity-containing feed gas are basic processes of obtaining a high-purity (the volume percentage is 99.999% or above) gas. Typically, the separation is performed by using a difference between condensing temperature and molecular properties of the component gases, and the traditional methods include: distillation, segregation, adsorption, catalytic reaction, and the like. When a product gas requires higher purity, it is necessary to use several methods in combination, for example, a method of combining, high-pressure low-temperature condensation and low-temperature adsorption or a method of combining pressure swing adsorption at room temperature and low-temperature adsorption. The traditional separation and purification method has a complicated process and a high investment cost, and is typically used in large gas separation and purification equipment.

Generally, separation and purification of helium, neon and other inert gases are also based on the foregoing several common methods. In inert gases, helium, neon and other inert gases have very important applications in fields such as aviation, aerospace, military and scientific research, and the demand increases day by day. What is important is that our comity belongs to countries poor in helium, and the United States as the world's major exporter of helium has listed helium as a strategic resource. Therefore, helium recycling is particularly important; besides, extraction from air separation units is one of the ways of obtaining helium and neon.

For recycled helium, its purity is about 90%, and the rest is mainly air and other impurity gases. The helium with the purity generally cannot be directly used, and needs to undergo a particular separation and purification process. For separation and purification of helium and neon in air separation units, the traditional method generally includes three working procedures, i.e., extraction of crude helium-neon gas mixture, preparation of pure helium-neon gas mixture, and preparation of pure helium and pure neon. The three working procedures all have a complicated process and a high investment cost, lack economy, and are rarely applied to actual air separation units.

The small-sized low-temperature refrigerating machine generally includes a GM refrigerating machine, a pulse tube refrigerating machine, a Stirling refrigerating machine, a J-T refrigerating machine and the like. A refrigerating temperature of the small-sized low-temperature refrigerating machine is generally in a range of 0-80K (−273.15° C.-193.15° C.), and the refrigerating output is around 0.1-100 W. The small-sized low-temperature refrigerating machine is an important device for obtaining extremely low temperature. The low-temperature device for separating and purifying gas based on the small-sized low-temperature refrigerating machine is applicable to small-scale gas separation and purification.

DISCLOSURE OF THE INVENTION

Technical Problem

The present invention provides a method for gas separation and purification based on a small-sized low-temperature refrigerating machine, which improves the traditional separation and purification solution, uses primary and secondary cold heads of the small-sized low-temperature refrigerating machine as cold sources, and liquefies and solidifies gases having different condensing temperature separately, so as to obtain a high-purity gas (for example, helium) having a lower condensing temperature, and other liquefied high-purity gases having a higher condensing temperature can also be obtained. In this way, two or more gases can be separated and purified at a lower cost.

The technical solution of the present invention is as follows:

A low-temperature device for separating and purifying gas based on a small-sized low-temperature refrigerating machine, including, a primary heat exchanger, a secondary heat exchanger, a quaternary heat exchanger, at least one small-sized low-temperature refrigerating machine, and at least one liquid collecting tank, where the small-sized low-temperature refrigerating machine includes a first cold head and a second cold head; the secondary heat exchanger is provided on the first cold head to form a primary cold head heat exchanger, and the quaternary heat exchanger is provided on the second cold head to form a secondary cold head heat exchanger; a mixed gas inlet, a mixed gas outlet, a purified gas inlet, and a purified gas outlet are provided on the primary heat exchanger, the mixed gas outlet is connected to an inlet of the primary cold head heat exchanger, an outlet of the primary cold head heat exchanger is connected to an inlet of the liquid collecting tank, a gas outlet of the liquid collecting tank is connected to an inlet of the secondary cold head heat exchanger, an outlet of the secondary cold head beat exchanger is connected to a first purified gas inlet at a cold end of the primary heat exchanger, and a hot end of the primary heat exchanger is a first purified gas outlet.

A tertiary heat exchanger is further provided between the gas outlet of the liquid collecting tank and the inlet of the secondary cold head heat exchanger, and the outlet of the secondary cold head heat exchanger is connected to the first purified gas inlet at the cold end of the primary heat exchanger through the tertiary heat exchanger.

Another refrigerating machine is further included, and the another refrigerating machine includes a primary heat exchange tank located at the first cold head and a secondary heat exchange tank located at the second cold head, a liquid outlet of the liquid collecting tank enters the first purified gas inlet at the cold end of the primary heat exchanger through the primary cold head heat exchanger, the gas outlet of the liquid collecting tank is connected to the inlet of the secondary cold head heat exchanger through the primary heat exchange tank, the outlet of the secondary cold head heat exchanger is connected to another liquid collecting tank, a gas outlet of the another liquid collecting tank is connected to a second purified gas inlet at the cold end of the primary heat exchanger through the secondary heat exchange tank, a liquid outlet of the another liquid collecting tank enters a third purified gas inlet at the cold end of the primary beat exchanger through the primary cold head heat exchanger and the primary heat exchange tank, the hot end of the primary heat exchanger is the first purified gas outlet, a second gas outlet and a third gas outlet.

The primary beat exchanger, the secondary heat exchanger, the tertiary beat exchanger, and the quaternary heat exchanger are of wound-tube heat exchanger, coiled pipe heat exchanger, plate heat exchanger or tinned heat exchanger types.

The small-sized low-temperature refrigerating machine is a GM refrigerating machine, a pulse tube refrigerating machine, a Stirling refrigerating machine or a J-T refrigerating machine.

Beneficial Effects

The present invention introduces a small-sized low-temperature refrigerating machine into the traditional gas separation and purification system, uses primary and secondary cold heads of the small-sized low-temperature refrigerating machine as cold sources, and liquefies and solidifies gases having different condensing temperature separately; after gases having a higher condensing temperature are liquefied at the primary cold head of the refrigerating machine, purity of gases having a lower condensing temperature will reach more than 90%, about 1% of impurity gases non-liquefied remain, and the impurity gases need to be solidified with lower-temperature cold sources (provided by the secondary cold head of the refrigerating machine), where the lower the temperature of the cold source is, the higher the gas purity is, and gas purity after solidification is usually more than 99.999%. In this way, two or more gases can be separated and purified at a lower cost.

DETAILED DESCRIPTION

The present invention is further described below with reference to the accompanying drawings and embodiments.

Embodiment 1 is a low-temperature device for separating and purifying gas based on a GM refrigerating machine that obtains high-purity helium and nitrogen.

Figure 1:
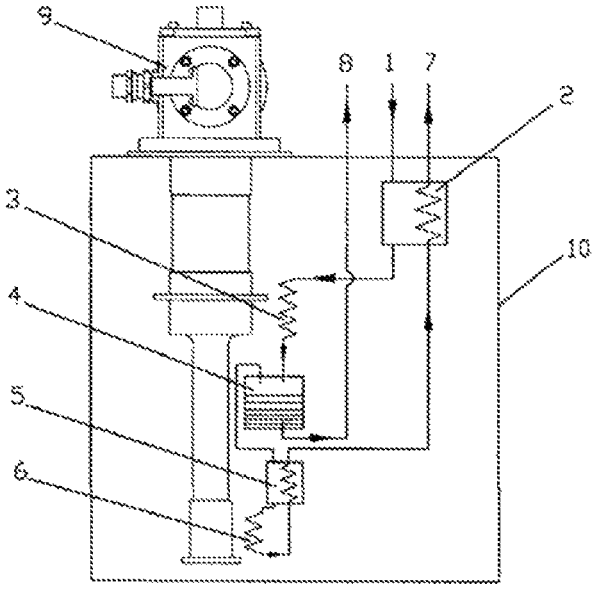
FIG. 1 is a schematic diagram of a low-temperature device for separating and purifying gas based on a GM refrigerating machine that obtains high-purity helium and nitrogen according to the present invention.

As shown in FIG. 1, the low-temperature device for separating and purifying gas based on a GM refrigerating machine includes a mixed gas inlet 1, a primary heat exchanger 2, a secondary heat exchanger 3, a liquid collecting tank 4, a tertiary heat exchanger 5, a quaternary heat exchanger 6, a helium outlet 7, a nitrogen outlet 8, a GM refrigerating machine 9, and a vacuum housing 10. The mixed gas inlet 1 is connected to an inlet at a hot end of the primary heat exchanger 2, an outlet at a cold end of the primary heat exchanger 2 is connected to an inlet of the secondary heat exchanger 3, the secondary heat exchanger 3 is wound on a primary cold head of the GM refrigerating machine, an outlet of the secondary heat exchanger 3 is connected to a gas inlet of the liquid collecting tank 4, a gas outlet of the liquid collecting tank 4 is connected to an inlet at a hot end of the tertiary heat exchanger 5, an outlet at to cold end of the tertiary heat exchanger 5 is connected to an inlet of the quaternary heat exchanger 6, the quaternary beat exchanger 6 is wound on a secondary cold head of the GM refrigerating machine, an outlet of the quaternary heat exchanger 6 is connected to an inlet at the cold end of the tertiary heat exchanger 5, an outlet at the hot end of the tertiary heat exchanger 5 is connected to an inlet at the cold end of the primary heat exchanger 2, an outlet at the hot end of the primary heat exchanger 2 is connected to the helium outlet 7, and a liquid outlet of the liquid collecting tank 4 is connected to the nitrogen outlet 8. The primary and secondary cold heads of the GM refrigerating machine 9, the primary heat exchanger 2, the secondary heat exchanger 3, the tertiary heat exchanger 5, the quaternary heat exchanger 6 and the liquid collecting tank 4 are placed in the vacuum housing 10.

The low-temperature device for separating and purifying gas based on a GM refrigerating machine that obtains high-purity helium and nitrogen has the following workflow.

A feed gas (containing helium and nitrogen), after entering the system from the mixed gas inlet 1, first enters the primary heat exchanger 2 for pre-cooling, and then enters the secondary heat exchanger 3 for further cooling after being pre-cooled to as lower temperature, and the secondary heat exchanger 3 is wound on the primary cold head of the GM refrigerating machine 9.

The feed gas is a gas-liquid mixture when leaving the outlet the secondary heat exchanger 3, the majority of the nitrogen in the feed gas has been liquefied, the gas-liquid mixture enters the liquid collecting tank 4 and then is gas-liquid separated, the liquid is aggregated in the bottom of the liquid collecting tank 4, and in this case, the gas leaving the liquid collecting tank 4 still contains a small amount of non-liquefied nitrogen.

The helium and the small amount of non-liquefied nitrogen leave the liquid collecting tank 4 and then enter the tertiary heat exchanger 5 to be cooled again, the small amount of non-liquefied nitrogen is solidified in the tertiary heat exchanger 5, and purity of helium coming out of the tertiary heat exchanger 5 reaches more than 99.999%, which is a high purity gas.

The high purity gas enters the quaternary heat exchanger 6, and the quaternary heat exchanger 6 is wound on the secondary cold bead of the GM refrigerating machine 9. The temperature of the helium leaving the quaternary heat exchanger 6 reaches a minimum value, the helium first passes through the tertiary heat exchanger 5, then passes through the primary heat exchanger 2, and then returns to the room temperature to reach the helium outlet 7, and emission of the liquefied nitrogen in the liquid collecting tank 4 is automatically controlled at regular intervals.

Embodiment 2 is a low-temperature device for separating and purifying gas based on a GM refigerating, machine that obtains three product gases, i.e., high-purity helium, neon and nitrogen.

Figure 2:
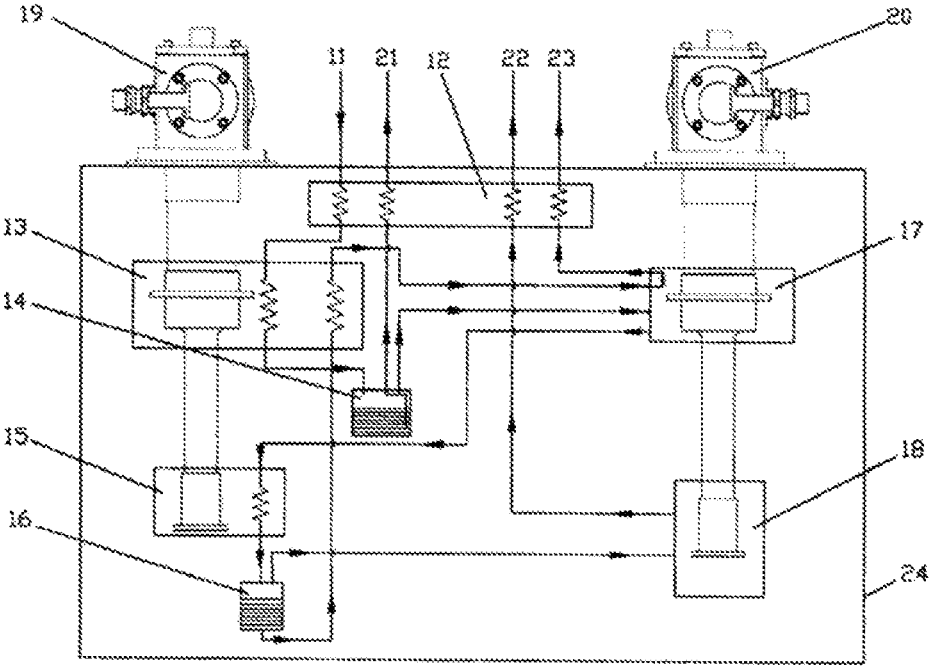
FIG. 2 is a schematic diagram of a low-temperature device for separating and purifying gas based on a GM refrigerating machine that obtains three product gases, i.e., high-purity helium, neon and nitrogen, according to the present invention.

As shown in FIG. 2, the low-temperature device for separating and purifying has based on a GM refrigerating machine includes a feed gas inlet 11, a primary heat exchanger 12, a primary cold head heat exchanger 13, a first liquid collecting tank 14, a secondary cold head heat exchanger 15, a second liquid collecting tank 16, a primary heat exchange tank 17, a secondary heat exchange tank 18, a first GM refrigerating machine 19, a secondary GM refrigerating machine 20, a nitrogen outlet 21, a helium outlet 22, a neon outlet 23 and a vacuum housing 24.

The low-temperature device for separating and purifying gas based on a GM refrigerating machine that obtains three product gases, i.e., high-purity helium, neon and nitrogen, has the following workflow.

A feed gas (containing helium, neon and nitrogen) first enters the primary heat exchanger 12 for pre-cooling from the feed gas inlet 11. The feed gas after being pre-cooled by the primary heat exchanger 12 enters the primary cold head heat exchanger 13 for further cooling, to liquefy nitrogen in the feed gas, and the feed gas is converted to a gas-liquid mixture containing liquid nitrogen, gaseous nitrogen, helium and neon at an outlet of the primary cold head heat exchanger 13.

The gas-liquid mixture, after flowing out of the primary cold head heat exchanger 13, flows into the first liquid collecting tank 14, gases and liquids are separated in the first liquid collecting tank 14, separated liquid nitrogen flows back to the primary heat exchanger 12 to pre-cool the feed gas, and separated helium, neon and non-liquefied nitrogen enter the primary heat exchange tank 17 for continuous cooling.

The non-liquefied nitrogen is solidified in the primary heat exchange tank 17, and a gas flowing out of the primary heat exchange tank 17 is a mixed gas of helium and neon.

The mixed gas of helium and neon enters the secondary cold head heat exchanger 15 for further cooling, the neon therein is liquefied, and the mixed gas of helium and neon is converted to a gas-liquid mixture containing liquid neon, gaseous neon and helium at an outlet of the secondary cold head heat exchanger 15.

After flowing out of the secondary cold head heat exchanger 15, the gas-liquid mixture of liquid neon, gaseous neon and helium flows into the second liquid collecting tank 16, gases and liquids are separated in the second liquid collecting tank 16, and separated helium and non-liquefied neon enter the secondary heat exchange tank 18.

The non-liquefied neon is solidified in the secondary heat exchange tank 18, a gas flowing out of the secondary heat exchange tank 18 is low-temperature high-purity helium, the low-temperature high-purity helium flows back to the primary heat exchanger 12, to pre-cool a room-temperature feed gas, the helium is rewarmed to the room temperature, and room-temperature high-purity helium can be obtained.

The separated liquid neon flows back to the primary cold had heat exchanger 13, to pre-cool the feed gas pre-cooled by the primary heat exchanger 12, the liquid neon absorbs heat to be converted to a gaseous state and is rewarmed, the rewarmed neon enters the primary heat exchange tank 17 to be cooled once again and then flows into the primary heat exchanger 12 to pre-cool the room-temperature feed gas, the low-temperature neon is rewarmed to the room temperature in the primary heat exchanger 12, and room-temperature high-purity neon can be obtained.

The embodiment 1 and the embodiment 2 merely describe principles and methods of obtaining two product gases and three product gases respectively, and it is required to make improvements on the basis of obtaining three product gases if it is necessary to obtain more product gases.

Content not involved in the present invention is the same as that in the prior art or can be implemented with the prior art.

What is claimed is:

1. A low-temperature device for separating and purifying gas based on a small-sized low-temperature refrigerating machine, comprising a primary heat exchanger, a secondary heat exchanger, a quaternary heat exchanger, at least one small-sized low-temperature refrigerating machine, and at least one liquid collecting tank located between the secondary heat exchanger and the quaternary heat exchange to form a gas path from the secondary heat exchange, to the liquid collecting tank, then to the quaternary heat exchanger such that mixed gas from the secondary heat exchanger reaches the liquid collecting tank before reaching the quaternary heat exchanger, wherein the small-sized low-temperature refrigerating machine comprises a first cold head and a second cold head, the secondary heat exchanger is provided on the first cold head to form a primary cold head heat exchanger, the quaternary heat exchanger is provided on the second cold head to form a secondary cold head heat exchanger, a mixed gas inlet, a mixed gas outlet, a purified gas inlet, and a purified gas outlet are provided on the primary heat exchanger, the mixed gas outlet is connected to an inlet of the primary cold head heat exchanger, an outlet of the primary cold head heat exchanger is connected to an inlet of the liquid collecting tank, a gas outlet of the liquid collecting tank is connected to an inlet of the secondary cold head heat exchanger, an outlet of the secondary cold head heat exchanger is connected to the purified gas inlet at a cold end of the primary heat exchanger, and a hot end of the primary heat exchanger is a first purified gas outlet.

2. The low-temperature device for separating and purifying gas based on a small-sized low-temperature refrigerating machine according to claim 1, wherein a tertiary heat exchanger is further provided between the gas outlet of the liquid collecting tank and the secondary cold head heat exchanger, and the outlet of the secondary cold head heat exchanger is connected to the first purified gas inlet at the cold end of the primary heat exchanger through the tertiary heat exchanger.

3. The low-temperature device for separating and purifying gas based on a small-sized low-temperature refrigerating machine according to claim 1, further comprising another refrigerating machine, wherein the another refrigerating machine comprises a primary heat exchange tank located at the first cold head and a secondary heat exchange tank located at the second cold head, a liquid outlet of the liquid collecting tank enters the first purified gas inlet at the cold end of the primary heat exchanger through the primary cold head heat exchanger, the gas outlet of the liquid collecting tank is connected to the inlet of the secondary cold head heat exchanger through the primary heat exchange tank, the outlet of the secondary cold head heat exchanger is connected to another liquid collecting tank, a gas outlet of the another liquid collecting tank is connected to a second purified gas inlet at the cold end of the primary heat exchanger through the secondary heat exchange tank, a liquid outlet of the another liquid collecting tank enters a third purified gas inlet at the cold end of the primary heat exchanger through the primary cold head heat exchanger and the primary heat exchange tank, the hot end of the primary heat exchanger is the first purified gas outlet, a second gas outlet and a third gas outlet.

4. The low-temperature device for separating and purifying gas based on a small-sized low-temperature refrigerating machine according to claim 2, wherein the primary heat exchanger, the secondary heat exchanger, the tertiary heat exchanger and the quaternary heat exchanger are of wound-tube heat exchanger, coiled pipe heat exchanger, plate heat exchanger or finned heat exchanger types.

5. The low-temperature device for separating and purifying gas based on a small-sized low-temperature refrigerating machine according to claim 4, wherein the small-sized low-temperature refrigerating machine is a GM refrigerating machine, a pulse tube refrigerating machine, a Stirling refrigerating machine or a J-T refrigerating machine.

6. The low-temperature device for separating and purifying gas based on a small-sized low-temperature refrigerating machine according to claim 2, wherein the primary heat exchanger, the secondary heat exchanger, the tertiary heat exchanger and the quaternary heat exchanger are of wound-tube heat exchanger, coiled pipe heat exchanger, plate heat exchanger or finned heat exchanger types.

7. The low-temperature device for separating and purifying gas based on a small-sized low-temperature refrigerating machine according to claim 3, wherein the primary heat exchanger, the secondary heat exchanger, the tertiary heat exchanger and the quaternary heat exchanger are of wound-tube heat exchanger, coiled pipe heat exchanger, plate heat exchanger or finned heat exchanger types.

8. The low-temperature device for separating and purifying gas based on a small-sized low-temperature refrigerating machine according to claim 6, wherein the small-sized low-temperature refrigerating machine is a GM refrigerating machine, a pulse tube refrigerating machine, a Stirling refrigerating machine or a J-T refrigerating machine.

9. The low-temperature device for separating and purifying gas based on a small-sized low-temperature refrigerating machine according to claim 7, wherein the small-sized low-temperature refrigerating machine is a GM refrigerating machine, a pulse tube refrigerating machine, a Stirling refrigerating machine or a J-T refrigerating machine.

* * * * *